US006224963B1

(12) United States Patent
Strangman

(10) Patent No.: US 6,224,963 B1
(45) **Date of Patent: *May 1, 2001**

(54) LASER SEGMENTED THICK THERMAL BARRIER COATINGS FOR TURBINE SHROUDS

(75) Inventor: Thomas E. Strangman, Phoenix, AZ (US)

(73) Assignee: AlliedSignal Inc., Morris Township, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/067,257

(22) Filed: Apr. 27, 1998

Related U.S. Application Data

(60) Provisional application No. 60/046,409, filed on May 14, 1997.

(51) Int. Cl.[7] ..... B32B 3/00; C03C 27/02

(52) U.S. Cl. ..... 428/172; 428/137; 428/167; 428/632; 428/633; 428/469; 428/472; 428/701

(58) Field of Search ..... 428/167, 172, 428/432, 632, 633, 469, 472, 701, 702; 415/173.1, 173.4, 200

(56) References Cited

U.S. PATENT DOCUMENTS

| | | | |
|---|---|---|---|
| 3,415,672 | 12/1968 | Levinstein et al. | 117/71 |
| 3,489,537 | 1/1970 | Cook | 24/194 |
| 3,849,865 | 11/1974 | Gedwill et al. | 29/460 |
| 3,869,779 | 3/1975 | Gedwill et al. | 29/194 |
| 3,955,935 | 5/1976 | Shockley et al. | 29/194 |
| 3,978,251 | 8/1976 | Stetson et al. | 427/229 |
| 3,979,534 | 9/1976 | Rairden, III | 427/405 |
| 3,996,021 | 12/1976 | Chang et al. | 29/194 |
| 4,005,989 | 2/1977 | Preston | 29/194 |
| 4,080,486 | 3/1978 | Walker et al. | 428/653 |
| 4,248,940 | 2/1981 | Goward et al. | 428/633 |
| 4,298,385 | 11/1981 | Claussen et al. | 501/105 |
| 4,321,310 | 3/1982 | Ulion et al. | 428/612 |
| 4,321,311 | 3/1982 | Strangman | 428/623 |
| 4,335,190 | 6/1982 | Bill et al. | 428/623 |
| 4,374,183 | 2/1983 | Deadmore et al. | 428/641 |
| 4,401,697 | 8/1983 | Strangman | 427/250 |
| 4,405,659 | 9/1983 | Strangman | 427/248.1 |
| 4,405,660 | 9/1983 | Ulion et al. | 427/248.1 |
| 4,414,249 | 11/1983 | Ulion et al. | 427/248.1 |
| 4,447,503 | 5/1984 | Dardi et al. | 428/632 |
| 4,676,994 | 6/1987 | Demaray | 421/47 |

(List continued on next page.)

FOREIGN PATENT DOCUMENTS

| | | |
|---|---|---|
| 0 609 795 A1 | 1/1994 | (EP) . |
| 2 269 392 | 6/1992 | (GB) . |

OTHER PUBLICATIONS

Article from Journal of Non–Crystalline Solids 147/148 (1992) Oct. 1, Amsterdam, NL entitled Corrosion resistant sol–gel ZrO2 coating on stainless steel by M. Atik and M.A. Aegerter.

*Primary Examiner*—Donald Loney
(74) *Attorney, Agent, or Firm*—Robert Desmond, Esq.

(57) ABSTRACT

A turbine shroud having a coating comprising a bond layer covering the shroud substrate, and a thick ceramic stabilized zirconia layer with a segmented morphology covering the bond coat. The segmented morphology is defined by an array of slots or grooves which extend from the outer surface of the ceramic layer inwards through almost the entire thickness of the coating but without piercing the underlying substrate. The segmented morphology comprises a plurality of grooves that are laser drilled into the ceramic layer. Each groove is formed by laser drilling a series of holes that are spaced from each other so that the groove has a fully segmented portion and a partially segmented portion.

12 Claims, 1 Drawing Sheet

U.S. PATENT DOCUMENTS

| | | | |
|---|---|---|---|
| 4,880,614 | 11/1989 | Strangman et al. | 428/625 |
| 4,916,022 | 4/1990 | Solfest et al. | 428/623 |
| 5,015,502 | 5/1991 | Strangman et al. | 427/248.1 |
| 5,059,095 | 10/1991 | Kushner et al. | 416/241 |
| 5,073,433 | 12/1991 | Taylor | 428/134 |
| 5,238,752 | 8/1993 | Duderstadt et al. | 428/623 |
| 5,352,540 * | 10/1994 | Schienle et al. | 428/623 |
| 5,498,484 | 3/1996 | Duderstadt | 428/633 |
| 5,562,998 | 10/1996 | Strangman | 428/612 |
| 5,630,314 | 5/1997 | Kojima et al. | 60/39.182 |

* cited by examiner

LASER SEGMENTED THICK THERMAL BARRIER COATINGS FOR TURBINE SHROUDS

REFERENCE TO COPENDING APPLICATION

This application claims the benefit of U.S. Provisional Application Ser. No. 60/046,409 filed May 14, 1997.

GOVERNMENT RIGHTS

This invention was made with Government support under Contract Nos. DAAJ02-89-C-0036 awarded by the United States Army, N00019-89-C-0163 awarded by the United States Navy, and F33657-89-C-2013 awarded by the United States Air Force. The Government has certain rights in this invention.

TECHNICAL FIELD

This invention relates to insulative and abradable ceramic coatings, and more particularly to ceramic turbine shroud coatings, and more particularly to a segmented ceramic coated turbine shroud and a method of making by laser cutting grooves through the ceramic coating in a grid pattern.

BACKGROUND OF THE INVENTION

Those skilled in the art know that the efficiency loss of a high pressure turbine increases rapidly as the blade tip-to-shroud clearance is increased, either as a result of blade tip wear resulting from contact with the turbine shroud or by design to avoid blade tip wear and abrading of the shroud. Any high pressure air that passes between the turbine blade tips and the turbine shroud does not do work and therefore is a system loss. Another loss is the use of compressor bleed air to cool the turbine shroud. If an insulative shroud technology could be provided which allows blade tip clearances to be small over the life of the turbine, there would be an increase in the overall turbine performance, including higher power output at a lower operating temperatures, better utilization of fuel, longer operating life, and reduced shroud cooling requirements.

To this end, efforts have been made in the gas turbine industry to develop abradable turbine shrouds to reduce clearance and associated leakage losses between the blade tips and the turbine shroud. Various techniques have been developed for coating turbine shrouds with ceramic materials such as, primarily, yttria stabilized zirconia. A disadvantage of these techniques is that the ceramic coating tends to spall off due to the steep thermal gradient across the thickness of the ceramic during engine operation. The spalling off severely reduces the sealing effectiveness and the insulative characteristics of the ceramic coating, causing shroud distortion, which results in a variation in the blade tip-to-shroud clearance, loss of performance, and expensive repairs.

Strangman, U.S. Pat. No. 4,914,794, entitled "Method of Making an Abradable Strain-Tolerant Ceramic coated Turbine Shroud", which is assigned to the assignee of this application and incorporated by reference herein, provides a solution to the spalling off problem. Strangman discloses an abradable ceramic coated turbine shroud structure which includes a grid of slant-steps isolated by grooves in a superalloy metal shroud substrate. A thin bonding layer is applied to the slant-steps, followed by a stabilized zirconia layer that is plasma sprayed at a sufficiently large spray angle to cause formation of deep shadow gaps in the zirconia layer. The shadow gaps provide strain tolerance, avoiding spalling. However, the invention in Strangman requires that the substrate surface have sufficient thickness to accommodate the grooves formed therein. For thin metal turbine shrouds with a thick ceramic coating, it becomes impractical to have a deep enough groove in the metal substrate to cause adequate shadow gaps to form in the zirconia.

Schienle et al., U.S. Pat. No. 5,352,540, entitled "Strain-Tolerant Ceramic Coated Seal", which is assigned to the assignee of this application and also incorporated by reference herein, provides a method of laser machining an array of grooves into a ceramic high temperature solid lubricant surface layer of a seal. When applied to a thin turbine shroud coated with a thick TBC layer, however, the results have not been satisfactory. Particularly with a thin substrate, the depth of the groove must be accurately controlled, so as to be deep enough to provide strain relief, but not touch the substrate. The laser machining method of Schienle does not provide the required level of control over the groove depth. Also, stabilized zirconia vapor produced by the laser machining process tends to fill in the groove behind the laser. To compensate for this back filling phenomenon, the grooves must made be excessively wide, which takes away from the sealing effectiveness of the shroud.

SUMMARY OF THE INVENTION

An object of the present invention is to provide a method for forming a segmented morphology in a thick ceramic thermal barrier coating on a thin metal turbine shroud.

Another object of the present invention is to provide a thin metal turbine shroud having a thick ceramic thermal barrier coating layer that is strain tolerant.

Yet still another object of the present invention is to provide a less expensive strain tolerant ceramic thermal barrier coating.

The present invention achieves these objects by providing a turbine shroud having a coating comprising a bond layer covering the shroud substrate, and a thick ceramic stabilized zirconia layer with a segmented morphology covering the bond coat. The segmented morphology is defined by an array of slots or grooves which extend from the outer surface of the ceramic layer inwards through almost the entire thickness of the coating but without piercing the underlying substrate. The segmented morphology comprises a plurality of grooves that are laser drilled into the ceramic layer. Each groove is formed by laser drilling a series of holes that are spaced from each other so that the groove has a fully segmented portion and a partially segmented portion.

DESCRIPTION OF THE PREFERRED EMBODIMENT

Figure 1:
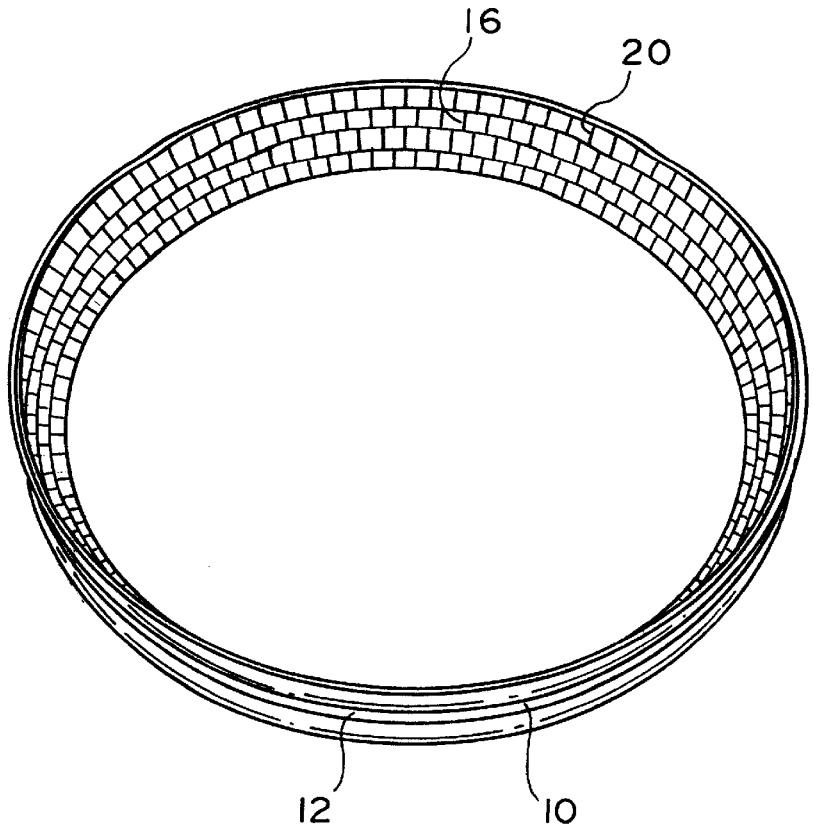
FIG. 1 is a perspective view of a turbine shroud having a laser segmented thick thermal barrier coating as contemplated by the present invention.

Referring to drawings, a turbine shroud to which the present invention relates is generally denoted by the reference numeral 10. The turbine shroud 10 comprises a thin, metallic ring or substrate 12 having an inner surface covered by a bond coat 14 which in turn is covered by a thick ceramic thermal barrier coating or layer 16. The metallic ring or substrate 12 is preferably greater than 0.010 inch thick, and made of a high nickel, cobalt, or iron based high temperature structural metal or alloy from which turbine shrouds and other gas turbine engine components are commonly made. Preferably, the substrate 12 is Hastalloy 25, or Mar-M 509.

The bond coat or layer 14 lies over the inner surface of the substrate 12. The bond coat 14 is usually comprised of a MCrAlY alloy. Such alloys have a broad composition of 10 to 35% chromium, 5 to 15% aluminum, 0.01 to 1% yttrium, or hafnium, or lanthanum, with M being the balance. M is selected from a group consisting of iron, cobalt, nickel, and mixtures thereot Minor amounts of other elements such as Ta or Si may also be present. These alloys are known in the prior art and are described in U.S. Pat. Nos. 4,880,614; 4,405,659; 4,401,696; and 4,321,311 which are incorporated herein by reference. The bond layer 16 is preferably NiCrAlY having the composition 31 weight percent chrome, 11 weight percent aluminum, 0.6 weight percent yttrium, the balance being nickel, and is preferably applied by an air plasma spray process, a low pressure (vacuum) plasma spray process, or an inert gas (e.g. argon) shrouded air plasma spray process. The layer 14 has a preferred thickness of about 0.004 inches. The selection of the plasma spray environment depends upon the substrate temperature and coating life requirements. The NiCrAlY layer 14 provides a high degree of adherence to the nickel based metallic surface 12 and also to the ceramic TBC coating deposited thereon.

The ceramic layer 16 is applied to the surface of the NiCrAlY bond layer 14 by an air plasma spray gun to a thickness that is preferably about 0.035 inches. The ceramic layer 16 is preferably formed of yttria stabilized zirconia having a composition nominally containing 8 weight percent yttria to inhibit formation of large volume fraction of monoclinic phase. The as sprayed surface of ceramic layer 16 has surface asperities which must be machined off to provide a smooth surface with sufficient tribological and sealing characteristics. The as-sprayed surface asperities of the layer 16 are removed by machining and/or grinding so that the layer 16 is with about 0.002 inches of its final thickness of about 0.030 inches.

An array of grooves 20 are cut into the outer surface 18 of the ceramic layer 16 using an automated pulsed carbon dioxide laser to form a series of closely spaced, tapered holes 22 with a distance, $D_3$, of 0.006 inch between hole centers. For a ceramic layer having a final thickness of 0.030 inches, the laser should be operated with a pulse width of 400 microseconds, a frequency of 278 Hz, a power setting of 112 watts, a 2.5 inch focal length, with an air pressure of 50 psi and a process rate of 100 inches per minute. Importantly, the drilling of each hole 22 with this separation enables the vaporized yttria stabilized zirconia to predominantly erupt out of the top of the hole thus minimizing undersireable deposition onto the walls of previously drilled holes and bridging between grooves. A portion of each hole 22 nearest the outer surface 18 as represented by dashed lines 24 does eventually break through to the preceding holes, forming a continuous, fully segmented zone 30 and a partially segmented zone 32 beneath.

Figure 2:
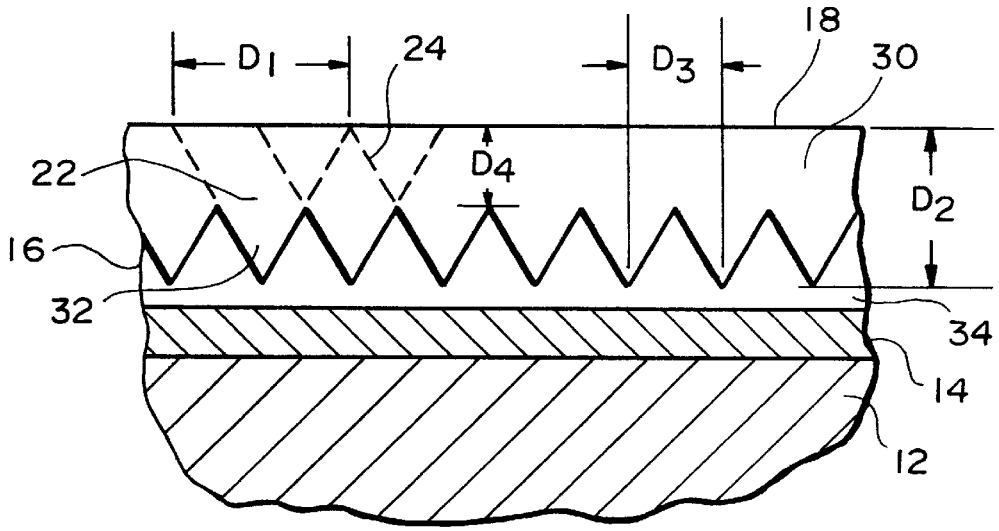
FIG. 2 is a cutaway view of the turbine shroud of FIG. 1.

Referring still to FIG. 2, the diameter $D_1$ of each hole 22 at the surface 18 is determined by the laser power required to produce holes of a depth $D_2$ which should be in the range of 70 to 100 percent of the thickness of the layer 16, but at most $D_1$ should be 0.010 inch (0.25 mm). The holes 22 should be drilled normal, within plus or minus 10 degrees, to the surface 18 with a nominal spacing $D_3$ between holes such that the fully segmented zone 30 has a depth $D_4$ that is at least 30 percent of the thickness of the layer 16. Smaller values of $D_2$ and $D_4$ are permitted for up to 5 percent of a groove's length. Also, gaps in the continuity of the series of holes, that is missing holes, can be tolerated provided the total length of the gaps do not exceed 5 percent of the groove's length.

The drilling of the holes 22 results in the formation of three zones in the layer 16. These are the fully segmented zone 30, the partially segmented zone 32, and an unsegmented zone 34. Zone 30 should preferably have a depth, $D_4$, of at least 30 percent of the thickness of layer 16. Beneath the zone 30 is the zone 32 which has a stichwork microstructure formed from the remaining hole bottoms. Preferably, the combined depth of both zones 30 and 32, $D_2$, should be between 70 and 100 percent of the thickness of layer 16. Finally, zone 34 is unsegmented and should have a thickness of between 0 to 30 percent of the thickness of layer 16.

The fully segmented or grooved zone 30 causes this portion of the layer 16 to have almost zero effective modulus of elasticity in the plane of the coating. This condition is advantageous because this zone experiences the most thermal growth, particular during the start of an engine where the ceramic surface layer 18 is hot and the substrate is cold.

The partially segmented zone 32 transitions in the plane modulus from zero at the interface with zone 30 to its maximum value at the interface with zone 34. The high modulus zone 34 is where thermal stresses are relatively low. Subsequent thermal cycling as may occur during post laser process heat treatment during engine operation, allows ceramic-substrate thermal expansion mismatch and thermal strains (stresses) to propagate microcracks in the zone 32 down to the top of the bond coating 14. This result is beneficial as it results in full segmentation of the ceramic layer 16 which lowers the in plane modulus in zones 32 and 34.

These graduated zones have a beneficial effect of accommodating the large disparity in thermal growth across the TBC layer. The high thermal resistance of the TBC results in a steep temperature gradient through its thickness; highest at its outer surface, and lowest adjacent the metal shroud. Without grooves, the hot surface portion expands much more than the relatively cool portion nearest the shroud, setting up a thermal fight. This thermal fight can cause cracking of the ceramic and spalling off. The graduated zones allow the hottest layers near the surface to expand almost unimpeded, thereby preventing a thermal fight and its damaging effects.

The laser is programmed to cut the rows of grooves 20 in two orthogonal directions such that the grooves are evenly spaced, forming a uniform gridwork appearance. The depth of the laser machined grooves 20, and the relative depths of the zones 31–33 may vary depending upon the thickness of the metal shroud 12 and the total thickness of the ceramic TBC. The process of drilling the grooves may result in adherent drilling debris attached to the outer surface 18. This debris needs to be removed by grinding to the required thickness, so as to make the surface aerodynamically smooth.

Thus a method is provided for laser cutting grooves in the TBC coating of a thin metal turbine shroud without cutting into the metal shroud, and that produces a graduated effect in the coating that accommodates the large differential in thermal growth between the hot surface of the TBC and the metal shroud.

An advantage of the present invention is that it is less costly when compared with the invention described Strangman, U.S. Pat. No. 4,914,794, entitled "Method of Making an Abradable Strain-Tolerant Ceramic coated Turbine Shroud". The reasons for this advantage are (1) the cost associated with machining a groove and/or slant step pattern into the superalloy substrate is eliminated; (2) the overall part is lighter as less superalloy material is needed; (3) machining the grooves into the ceramic layer is faster than machining the grooves into the substrate; (4) the thickness of the ceramic layer can be less because it does not have to fill the grooves in the substrate.

Though described with respect to a turbine shroud, the subject invention is applicable to other structures within a gas turbine engine such as combustors and liners, as well as to structures not related to gas turbine engines.

Various modifications and alterations of the above described invention will be apparent to those skilled in the art. Accordingly, the foregoing detailed description of the preferred embodiment of the invention should be considered exemplary in nature and not as limiting to the scope and spirit of the invention.

What is claimed is:

1. A superalloy article having a thermal barrier coating on at least a portion of its surface comprising:

a superalloy substrate;

a bond layer overlying said substrate; and a stabilized zirconia layer having an exposed outer surface and an inner surface overlying said bond layer, said zirconia layer having a plurality of grooves extending from the exposed outer surface towards said inner surface.

2. The article of claim 1 wherein said grooves are arranged in a predetermined array.

3. The article of claim 1 wherein each of said grooves is formed from drilling a plurality of overlapping tapered holes so that during the laser drilling of said holes the walls of adjacent holes are broken through whereby a portion of said zirconia layer is removed from said outer surface.

4. The article of claim 3 wherein said removed portion has a depth from said outer surface of at least 30 percent of the thickness of said zirconia layer.

5. The article of claim 4 wherein each of said holes has a diameter at said outer surface of at most 0.010 inch (0.25 mm).

6. The article of claim 3 wherein each of said grooves extends from said outer surface to a depth of between 70 percent to 100 percent of the thickness of said zirconia layer.

7. The article of claim 1 wherein said stabilized zirconia is yttria stabilized zirconia.

8. A superalloy article having a thermal barrier coating on at least a portion of its surface comprising:

a superalloy substrate;

a bond layer overlying said substrate; and a stabilized zirconia layer having an exposed outer surface and an inner surface overlying said bond layer, said zirconia layer further having a fully segmented zone extending inward from said exposed outer surface partway to said inner surface and a partially segmented zone between said fully segmented zone and said bond layer.

9. The article of claim 8 wherein said zirconia layer further includes an unsegmented zone between said bond layer and said partially segmented zone.

10. The article of claim 8 wherein the depth of said fully segmented zone is at least 30 percent of the thickness of said zirconia layer.

11. The article of claim 8 wherein the depth of said fully segmented zone and said partially segmented zone is at least 70 percent of the thickness of said zirconia layer.

12. The article of claim 8 wherein said stabilized zirconia is yttria stabilized zirconia.

* * * * *